US011348744B2

(12) United States Patent
Hosp et al.

(10) Patent No.: US 11,348,744 B2
(45) Date of Patent: May 31, 2022

(54) SWITCHING PROFILE

(71) Applicant: BBC Bircher AG, Beringen (CH)

(72) Inventors: Dietmar Hosp, Klettgau (DE); Heinz Macher, Schaffhausen (CH)

(73) Assignee: BBC Bircher AG, Beringen (CH)

( * ) Notice: Subject to any disclaimer, the term of this patent is extended or adjusted under 35 U.S.C. 154(b) by 0 days.

(21) Appl. No.: 16/977,843

(22) PCT Filed: Feb. 28, 2019

(86) PCT No.: PCT/EP2019/054976
§ 371 (c)(1),
(2) Date: Sep. 3, 2020

(87) PCT Pub. No.: WO2019/170510
PCT Pub. Date: Sep. 12, 2019

(65) Prior Publication Data

US 2021/0027956 A1 Jan. 28, 2021

(30) Foreign Application Priority Data

Mar. 5, 2018 (DE) ..... 10 2018 104 922.6

(51) Int. Cl.
*E05F 15/44* (2015.01)
*H01H 3/16* (2006.01)

(52) U.S. Cl.
CPC ..... *H01H 3/161* (2013.01); *E05F 15/44* (2015.01); *E05Y 2400/445* (2013.01); *E05Y 2900/132* (2013.01); *H01H 2003/165* (2013.01)

(58) Field of Classification Search
USPC ..... 200/47
See application file for complete search history.

(56) References Cited

U.S. PATENT DOCUMENTS 9,417,099 B2 8/2016 Bolbocianu et al.

FOREIGN PATENT DOCUMENTS

| | | | |
|---|---|---|---|
| CN | 105620234 | A | 6/2016 |
| DE | 8608064 | U1 | 5/1986 |
| DE | 9403972 | * | 7/1994 |
| DE | 9403972 | U1 | 7/1994 |
| DE | 29804732 | U1 | 5/1998 |
| DE | 29808292 | U1 | 7/1998 |

(Continued)

OTHER PUBLICATIONS

International search report for patent application No. PCT/EP2019/054976 dated May 27, 2019.

*Primary Examiner* — Toan T Vu
*Assistant Examiner* — Xuan Ly
(74) *Attorney, Agent, or Firm* — Bachman and Lapointe PC; George Coury

(57) ABSTRACT

The invention relates to a switching profile (1) with a switching head (4) and a first side wing (2) and a second side wing (3), wherein a concave profile (12) and a convex profile (13) are arranged in a manner oriented towards one another in an interior (29) of the switching head (4), wherein the switching head (4) consists of a base (28), a first side wing (21) and a second side wing (22), wherein the first side wing (21) projects away from the base (28) at one end and merges into a crown (19) at the other end, wherein the second side wing (22) projects away from the base (28) at one end and likewise merges into the crown (19) at the other end.

8 Claims, 2 Drawing Sheets

(56) References Cited

FOREIGN PATENT DOCUMENTS

| | | | | |
|---|---|---|---|---|
| EP | 1926113 | | * | 5/2008 |
| EP | 1926113 | A1 | | 5/2008 |
| EP | 3023280 | | * | 5/2016 |
| EP | 3023280 | A1 | | 5/2016 |

* cited by examiner

SWITCHING PROFILE

BACKGROUND OF THE INVENTION

The invention refers to a switching profile.

Such switching profiles are already known and used in various forms and designs.

In EP 1 926 113 A 1, for example, an overrun profile, in particular for doors or gates provided with a drive, is disclosed which reacts to a pressure signal, with a rubber profile which has a switching chamber for receiving at least one power-operated switching strip and/or a pressure wave contact device as switching element(s) and an overrun strip, which is connected to the switching chamber in a force-transmitting manner, whereby the clear cross-section of the switching chamber can be changed in size, whereby the switching chamber is equipped with pivoting lever arms such as flanges, bars, projections or the like, through which the switching chamber can be changed in size when pivoting for assembly of the overrun profile, whereby the switching element being inserted into the switching chamber before the lever arms are pivoted for mounting and is held in place in the switching chamber without play by the pivoting of the lever arms for mounting.

The DE 298 04 732 U1, for example, shows such an overrun profile, which is mounted on a roller door with a carapace running in guide rails, consisting of rods pushed into each other, namely on the lowest rod as an end strip in the form of an elastic overrun profile made of rubber. Here the overrun profile has an upper switching chamber to receive a force-transmitting switching strip and a lower chamber for a pressure wave contact detection, whereby the two chambers for pressure transmission are connected to each other by a bar. The aim of this double-chamber design of a switching element is to simplify the storage, i.e. where previously two separate switching elements were necessary depending on the application of a switching strip or a pressure wave device; here both systems have been combined in one switching element so that this can be used alternatively.

The DE 298 08 292 U1 shows an end profile made of rubber for vertically liftable and lowerable door leaves. The flanges or edges running ahead in the closing direction are provided with a tubular channel in which a pressure-sensitive switching device is arranged. Since the switching device can respond to pressure, the clear cross-section of the switching chamber can be changed in size during the operation of the switching element. The contact strips can only be compressed by changing the aspect ratio of the chamber. The pressure is transmitted via the test rods. The described switching device is designed to be more sensitive, i.e. to respond even at lower forces. This is solved by the fact that the wall of the channel is provided with slots in its lower part. These slots create easily deformable strips and edge strips, so that the switching device arranged in the channel is actuated at much lower forces acting on the end profile.

SUMMARY OF THE INVENTION

The object of the present invention is to overcome the disadvantages of the prior art. In particular, a switching profile is to be provided which can be produced quickly and cost-effectively, requiring less assembly time and having optimum sensitivity.

The features disclosed herein lead to the solution of the object.

Advantageous designs are described herein.

A switching profile according to the invention has a switching head and a first side wing and a second side wing, whereby a concave profile and a convex profile being arranged in alignment with one another in an interior of the switching head, whereby the switching head comprising a base, a first side flank and a second side flank, whereby the first side flank protrudes from the base at one end and merging into a crest at the other end, whereby the second side flank protrudes from the base at one end and also merging into the crest at the other end.

All the relevant parts of the switching profile are extruded in one piece in one and the same step. The switching profile is used to secure gates, doors or the like whereby when the switching head is compressed, the concave profile and the convex profile come into contact with each other and a signal is generated or interrupted. This process in turn is used, for example, to stop or reverse motor-driven automatic doors, in order to protect trapped body parts from injury.

The advantage here is that the assembly times can be considerably reduced with the switching profile according to the invention. In addition, it is advantageously achieved that the end user is able to assemble the switch profile himself.

Furthermore, the switching profiles can be cost-effectively manufactured in prefabricated strip production and delivered to the customer for easy assembly.

The flat lying switching profiles can be produced more unproblematically due to the low overall height, which leads to a more precise and easier reproducibility. This in turn leads to higher production speeds and cost reductions in manufacturing.

Furthermore, there is a first binding point between the switching head and the first side wing, whereby a first folding channel is arranged at the first binding point. The purpose of the first folding channel is to make it easier and more convenient to pivot the first side wing. The binding point represents a material thinning.

There is a second binding point between the switching head and the second side wing, with a second folding channel located at the second binding point. The purpose of the second folding channel is to make it easier and more convenient to pivot the second side wing. The second binding point represents also a material thinning.

On the first side flank there is a first convex strip that is formed towards the concave profile. In the same way, a second convex strip is formed on the second side flank towards the concave profile. The convex strips are used for a better resetting of the switching head after the convex profile and the concave profile have made contact.

The concave profile has a round base into which the convex profile partially protrudes. If the switching head is compressed, the convex profile is positively engaged in the round base.

Furthermore, a first connecting piece and a first support tab is formed on the first side wing, whereby a second connecting piece and a second support tab is formed on the second side wing. The connecting pieces and the side wings are a one piece component of the two side flanks and, due to the material properties of rubber, have sufficient rigidity and flexibility to connect the switching profile to a receptacle on a gate or door.

The switching head, the two side wings, the concave profile and the concave profile are extruded in one piece. In the same way, the convex strips also belong to the switching head in one piece.

The method for producing a switching profile is characterized primarily by the fact that the switching head, the two side wings, the concave profile and the convex profile are extruded in one piece, whereby a strand is also co-extruded.

BRIEF DESCRIPTION OF THE DRAWINGS

Further advantages, features and details of the invention result from the following description of preferred embodiment and from the drawing; these show in FIG. 1 a sectional side view of a switching profile in rest position.

DETAILED DESCRIPTION

Figure 1:
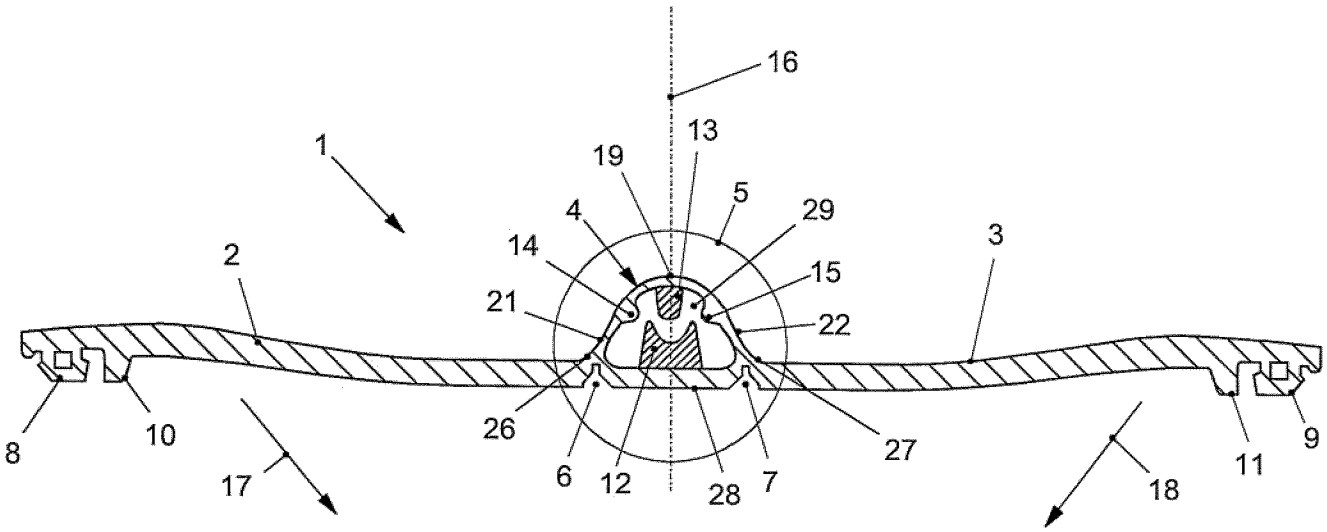

FIG. 1 shows a cut side view of a switching profile 1. The switching profile 1 primarily comprises three elements. A switching head 4 is shown centrally. From the switching head 4, a first side wing 2 on the one side and a second side wing 3 on the other side are strutted apart.

Figure 2:
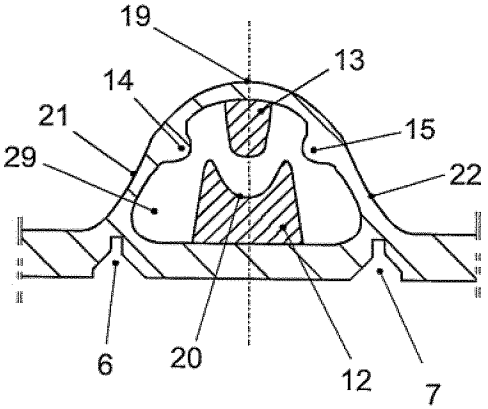
FIG. 2 an enlargement of a part of FIG. 1.

Further a section 5 is shown, which is enlarged in FIG. 2.

A first folding channel 6 is shown at the point where the first side wing 2 is molded onto the switching head 4. The first folding channel 6 tapers to a first binding point 26. In the same way, a second folding channel 7 is formed at a second binding point 27. The second folding channel 7 also tapers to the second binding point 27. The first folding channel 6 and the second folding channel 7 are opened away from the switching head 4.

At the one end, the first side wing 2 has the first folding channel 6. At the other end, the second side wing 3 has a first connecting piece 8. The first connecting piece 8 is an expansion element in the form of a hollow rubber profile. Between the first connecting piece 8 and the first folding channel 6, a first support tab 10 is also formed. The first connecting piece 8 and the first support tab 10 protrude from the same side of the first side wing 2.

A second folding channel 7 is shown at the point where the second side wing 2 is molded onto the switching head 4. The second folding channel 7 tapers to a second binding point 27.

At the one end, the second side wing 3 has the second folding channel 7. At the other end, the second side wing 3 has a second connecting piece 9. The second connecting piece 9 is also an expansion element in the form of a hollow rubber profile. Between the second connecting piece 9 and the second folding channel 7, a second support tab 11 is also formed. The second connecting piece 9 and the second support tab 11 protrude from the same side of the second side wing 3.

Also shown is a center line 16, which runs across the section view and through the center of the switching head 4.

A concave profile 12 and a convex profile 13 are arranged in the switching head 4. The switching head 4 consists primarily of a base 28, a first side flank 21, and a second side flank 22. In the rest position, the base 28 lies essentially in the same level and between the first side wing 2 and the second side wing 3. The base 28 is formed between the first folding channel 6 and the second folding channel 7 and merges into the first side flank 21 and the second side flank 22. The two side flanks 21, 22 meet at a crest 19.

The switching head 4 has a triangular design and encloses an interior 29, whereby the crest 19 represents a rounded surface which merges into the first side flank 21 and the second side flank 22.

In the interior 29, the concave profile 12 is placed on the base 28. The convex profile 13 is located at the crest 19 opposite the base 28. The convex profile 13 is convex and protrudes from the crest 19. The convex profile 12 forms a convex round base 20 viewed from the crest 19, in which the concave profile 13 partially protrudes in the working position. When the switching head 4 is compressed, the convex profile 13 moves into the round base 20 of the concave profile 12 and triggers a signal. This signal is then processed to stop an operation or to start another operation.

Furthermore, on the first side flank 21 in the interior 29 there is a first convex strip 14, which is integrally formed to the convex profile 13. Furthermore, a second convex strip 15 is provided on the second side flank 22 in the interior 29, which is integrally formed to the convex profile 13. The first convex strip 14 and the second convex strip 15 have an arc shape in sectional view, which protrudes from the side flanks 21, 22.

Figure 3:
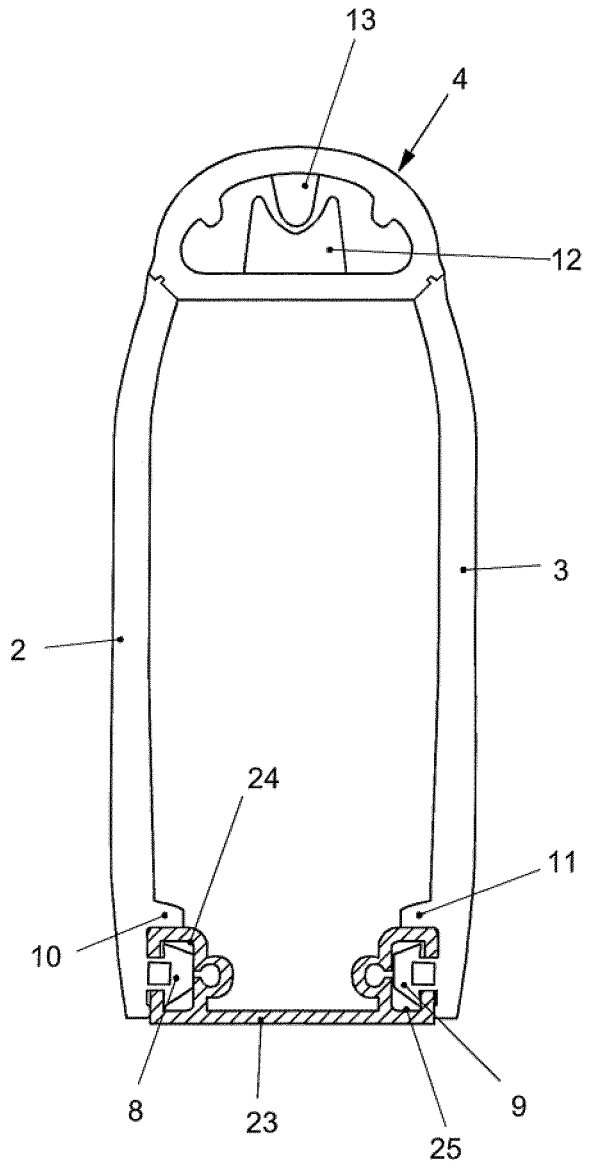
FIG. 3 a side view of the switching profile in working position.

To move the switching profile 1 from the rest position to the working position as shown in FIG. 3, the two side flanks 21, 22 are moved towards the center line 16. The direction is indicated by the first direction arrow 17 and the second direction arrow 18.

FIG. 2 shows an enlarged section of FIG. 1. The features shown there have already been shown and described in FIG. 1. The descriptions in FIG. 1 should also apply to FIG. 2.

In the working position, as shown in FIG. 3, the convex profile 13 partially protrudes into the concave profile 12 so that there is only a distance of 1 to 5 mm between the concave profile 12 and the concave profile 13.

The switching profile 1 is fixed in a receptacle profile 23. For this purpose, the receptacle profile 23 has a first side receptacle 24 and a second side receptacle 25. The first connecting piece 8 is inserted into the first side receptacle 24. The support tab 10 rests on the first side receptacle 24.

In the same way, the second connecting piece 9 is inserted into the second side receptacle 25, whereby the second support tab 11 rests on the second side receptacle 25.

A strand is present in the concave profile 12 and/or the convex profile 13.

Although only one preferred embodiment of the invention was described and presented, it is obvious that the skilled person can add numerous modifications without leaving the essence and scope of the invention.

The invention claimed is:

1. A switching profile with a switching head and a first side wing and a second side wing wherein a concave profile and a convex profile are arranged in alignment with one another in an interior of the switching head, whereby the switching head has a base, a first side flank and a second side flank, whereby the first side flank protrudes at one end from the base and at the other end merges into a crest, whereby the second side flank protrudes at one end from the base and at the other end also merges into the crest, and wherein a first convex strip is formed on the first side flank towards the concave profile and/or a second convex strip is formed on the second side flank towards the concave profile.

2. The switching profile according to claim 1, wherein a first binding point is provided between the switching head and the first side wing, whereby a first folding channel is arranged at the first binding point.

3. The switching profile according to claim 1, wherein a second binding point is provided between the switching head and the second side wing, whereby a second folding channel is arranged at the second binding point.

4. The switching profile according to claim 1, wherein the concave profile has a round base.

5. The switching profile according to claim 1, wherein a first connecting piece and a first support tab are formed on the first side wing.

6. The switching profile according to claim 1, wherein a second connecting piece and a second support tab are formed on the second side wing.

7. The switching profile according to claim 1, wherein the switching head, the two side wings, the concave profile and the convex profile are extruded in one piece.

8. A method for producing a switching profile with a switching head and a first side wing and a second side wing, wherein a concave profile and a convex profile are arranged in alignment with one another in an interior of the switching head, whereby the switching head has a base, a first side flank and a second side flank, whereby the first side flank protrudes at one end from the base and at the other end merges into a crest, whereby the second side flank protrudes at one end from the base and at the other end also merges into the crest, wherein a first convex strip is formed on the first side flank towards the concave profile and/or a second convex strip is formed on the second side flank towards the concave profile, and wherein the switching head, the two side wings, the concave profile and the convex profile are extruded in one piece.

* * * * *